United States Patent [19]

Murray

[11] Patent Number: 4,756,409

[45] Date of Patent: Jul. 12, 1988

[54] SHELF CHANNEL DISPLAY TRAY

[75] Inventor: James R. Murray, Fairport, N.Y.

[73] Assignee: Pennwalt Corporation, Philadelphia, Pa.

[21] Appl. No.: 102,284

[22] Filed: Sep. 28, 1987

Related U.S. Application Data

[63] Continuation of Ser. No. 005,005, Jan. 20, 1987, abandoned.

[51] Int. Cl.[4] ..... B65D 5/22; B65D 5/42

[52] U.S. Cl. ..... 206/45.34; 40/312; 206/232; 206/459; 211/73; 229/162; 229/185

[58] Field of Search ..... 40/10 D, 10 R, 306, 40/312, 313; 206/44 B, 44 K, 44 R, 45.14, 45.29, 45.31, 45.34, 232, 425, 459; 211/71–73; 229/40, 155, 162, 185

[56] References Cited

U.S. PATENT DOCUMENTS

| | | | |
|---|---|---|---|
| 267,700 | 1/1983 | Skarin | D9/337 |
| 1,497,519 | 6/1924 | Lewis | 206/44 R |
| 2,259,041 | 10/1941 | Larkin | 206/44 R |
| 2,964,169 | 12/1960 | Brachman | 206/44 R |
| 2,970,685 | 7/1961 | Mayer | 206/44 R |
| 3,358,820 | 12/1967 | Fairbairn | 206/45.31 |
| 3,567,014 | 3/1971 | Feigelman | 206/44 R |
| 3,581,977 | 6/1971 | Kirsky et al. | 229/128 |
| 3,765,527 | 10/1973 | Vargo | 206/44 R |
| 3,824,720 | 7/1974 | Langwell | 40/10 R |
| 3,912,158 | 10/1975 | Taub | 206/44 R |
| 3,961,706 | 6/1976 | Roccaforte et al. | 206/44 R |
| 4,111,413 | 9/1978 | Marcus | 272/1 R |
| 4,206,869 | 6/1980 | Gurevitz | 40/312 |
| 4,258,842 | 3/1981 | Falkstein | 206/45.34 |
| 4,382,504 | 5/1983 | Vesborg | 206/44 R |
| 4,396,115 | 8/1983 | Watson | 206/44 R |
| 4,396,121 | 8/1983 | Lemmon | 206/566 |
| 4,477,017 | 10/1984 | Webinger | 229/185 |
| 4,505,059 | 3/1985 | Morris | 40/10 D |
| 4,553,680 | 11/1985 | Griggs et al. | 220/4 F |
| 4,618,090 | 10/1986 | Cortellucci | 206/45.34 |
| 4,630,731 | 12/1986 | Albery | 206/425 |

FOREIGN PATENT DOCUMENTS

| | | | |
|---|---|---|---|
| 0200712 | 7/1923 | United Kingdom | 206/44 R |

*Primary Examiner*—Jimmy G. Foster

[57] ABSTRACT

An open top clear display tray having a display or billboard panel extending downwardly from the tray's front panel. The display panel is positioned against the channel portion of shelves in drug stores, supermarkets, and the like, and includes a clear upper portion which permits information affixed to the channel to remain visible while the lower portion contains the promotional point-of-purchase display for increasing potential sales of those products contained within the display tray.

5 Claims, 1 Drawing Sheet

SHELF CHANNEL DISPLAY TRAY

This application is a continuation of application Ser. No. 005,005, filed Jan. 20, 1987, abandoned.

STATEMENT OF THE INVENTION

This invention relates to a visual display device and more particularly to an open top clear display tray for use along and against shelf channels of shelves in drug stores, supermarkets, and the like.

BACKGROUND AND SUMMARY OF THE INVENTION

Current display trays for use in drug stores and supermarkets, for example, take many physical forms and are made from various materials using various techniques. Many of these prior art trays comprise cardboard, Bristol board, or other stiff paper material which provide limited visibility of the products contained within the trays, thus reducing the point-of-purchase impact of the products to a prospective buyer. Further, existing display trays often employ many flaps, folds, cuts, tabs, reinforcing elements, adhesive components, ribs, grooves, supports, tucks, panels, and the like which require unnecessary time to assemble and expense to fabricate.

The present display tray is fabricated from a single blank of stiff plastic material, such as clear polyvinylchloride, for example, wherein each unassembled tray is provided with the needed cuts, cut-out, fold or score lines, tongue and tab, and manufacturer's glue strip, to thus enable even an inexperienced worker to assemble several of the trays in less than one minute. The resultant display tray is sufficiently sturdy and requires no front dust flap for purposes of additional rigidity. The normal dust flap however will function as a point-of-purchase display panel while yet providing full shelf channel visibility. Since the present display tray utilizes the existing dust fold as a display flap, no additional design or material cost is needed or required.

DETAILED DESCRIPTION OF THE INVENTION

Figure 1:
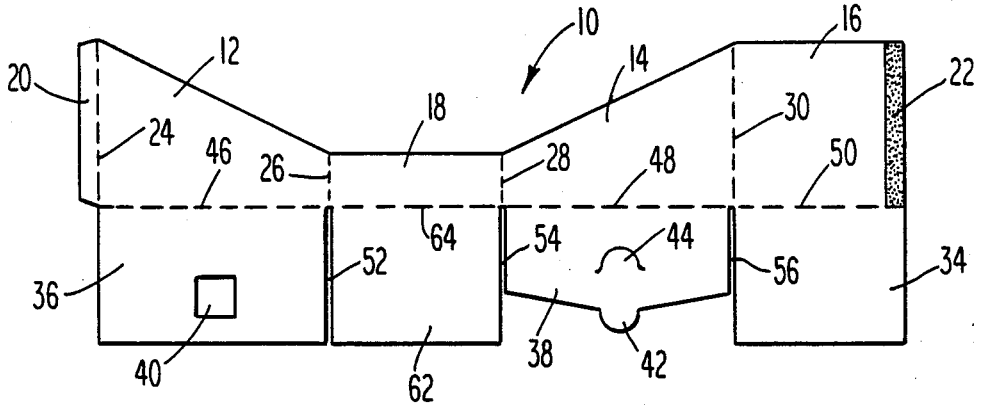
FIG. 1 is a plan view of a blank used in forming the display tray of the present invention.

In FIG. 1, a unitary blank 10 of stiff clear plastic material, typically polyvinylchloride, includes side panels 12 and 14, rear panel 16, and front panel 18. Side panel 12 and rear panel 16 are respectively provided with a glue flap 20 and glue strip 22 at their outermost end portions. Fold or score lines 24, 26, 28 and 30 are formed in blank 10 as illustrated. Optionally, glue or adhesive may be provided on the glue flap itself.

Figure 2:
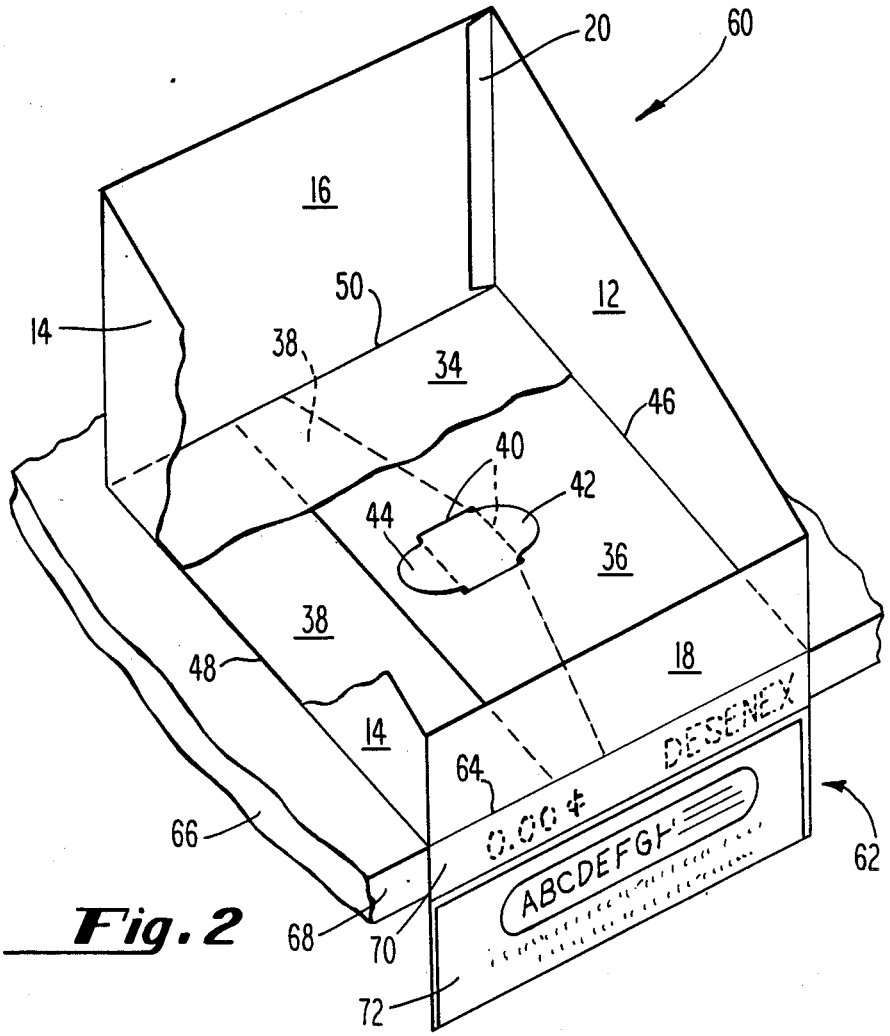
FIG. 2 is a perspective view, portions in phantom, of the display tray of FIG. 1 in assembled form, parts broken away for purposes of clarity of illustration.

Blank 10 further includes bottom flap 34, as well as flaps 36 and 38 which, when the tray is assembled as shown in FIG. 2, may be interlocked below bottom flap 34 by means of cut-out 40 receiving tab 42 and tongue 44, both provided on flap 38. Fold or score lines 46, 48 and 50, along with cuts 52, 54 and 56, permit ready assembly of the tray 60 (FIG. 2). Display or billboard panel 62 will be folded underneath the interlocked panels 36 and 38 along fold line 64 when the assembled tray 60, filled with product, is being transported. In use, the display panel 62 will depend from, or extend downwardly from front panel 18 to abut the shelf channel.

In assembling the tray 60 of FIG. 2 from blank 10, glue flap 20 is pressed onto glue strip 22 of rear panel 16, forming a rectangular enclosure having side panels 12 and 14, rear panel 16 and front panel 18. Panel 34 is next folded along fold line 50 to form a portion of the tray bottom. Opposing panels 36 and 38 may then be folded toward each other such that tab 42 and tongue 44 of panel 38 engage cut-out 40 provided in panel 36 to interlock the panels.

The assembled tray 60 is shown in position on a store shelf 66 having a shelf channel 68. The billboard or display panel 62 comprises two portions, i.e., an upper or clear portion 70 and a lower portion 72 displaying the promotional information. Upper portion 70 is of sufficient height, tyically $1\frac{1}{4}''$, to permit the information normally displayed along the shelf channel, i.e., unit price, name of item, etc., to remain visible. The lower portion 72 provides the trade acceptable point-of-purchase display for increasing the sales opportunity or potential of those products contained within the display tray.

As mentioned above, in shipment of the tray with product, billboard panel 62 will be folded underneath the interlocked panels 36 and 38 by means of fold or score line 64. Since tray 60 is not rectangular in side elevation, conventional fifth panel techniques will normally be employed.

I claim:

1. A display tray for use along and against a shelf channel, said tray made from a unitary blank of clear stiff plastic material for visually displaying a plurality of like products within said tray, said blank being cut and scored to provide said tray with a rear panel, a front panel of lesser height than said rear panel and disposed in substantially parallel relationship thereto, a pair of parallel disposed side panels interconnecting said rear panel with said front panel and sloping downwardly from said rear panel to said front panel, a bottom flap extending from said rear panel to form an upper bottom flap of said tray, a lower flap extending from each of said side panels and folded inwardly toward each other for interlocking engagement by cooperating interlocking means provided on each of said lower flaps to form lower bottom flaps of said tray, said front panel having a billboard panel extending downwardly therefrom for abutting said shelf channel, said billboard panel comprising a clear upper portion for permitting information affixed to said shelf channel to remain visible through said upper portion, and a lower portion for displaying promotional information regarding said product contained within said tray.

2. The tray of claim 1 wherein said clear upper portion of said billboard panel approximates width of said shelf channel.

3. The tray of claim 1 wherein said clear stiff plastic material is polyvinylchloride.

4. The tray of claim 1 wherein said cooperating interlocking means includes a cut-out portion provided in one of said lower flaps, and tab and tongue means provided in other of said lower flaps for engaging said cut-out portion to provide said interlocking engagement of said lower flaps.

5. The tray of claim 1 wherein said blank has one of said side panels provided with a glue flap extending therefrom and said rear panel is provided with a glue strip for reception of said glue flap thereon to thereby form a rectangularly configured enclosure defined by said cuts and scores provided to said blank.

* * * * *